US008336614B2

(12) United States Patent
Bagassi

(10) Patent No.: US 8,336,614 B2
(45) Date of Patent: Dec. 25, 2012

(54) MOVABLE ROTARY WELL DRILLING RIG

(76) Inventor: Walter Bagassi, Gropparello (IT)

( * ) Notice: Subject to any disclaimer, the term of this patent is extended or adjusted under 35 U.S.C. 154(b) by 523 days.

(21) Appl. No.: 12/460,269

(22) Filed: Jul. 16, 2009

(65) Prior Publication Data

US 2010/0012376 A1 Jan. 21, 2010

(30) Foreign Application Priority Data

Jul. 16, 2008 (IT) ..... PC2008A0033

(51) Int. Cl.
*E21B 19/081* (2006.01)
*E21B 3/02* (2006.01)
*E21B 15/00* (2006.01)

(52) U.S. Cl. ..... 166/77.1; 166/75.11; 175/195; 175/122

(58) Field of Classification Search ..... 175/423, 175/52, 85, 162, 195, 122, 170; 166/75.11, 166/77.51, 77.1
See application file for complete search history.

(56) References Cited

U.S. PATENT DOCUMENTS

| | | | | | |
|---|---|---|---|---|---|
| 2,200,075 | A | * | 5/1940 | Caldwell | 173/44 |
| 2,848,196 | A | * | 8/1958 | Simmonds | 175/52 |
| 3,082,607 | A | * | 3/1963 | Sutton | 405/196 |
| 3,126,063 | A | * | 3/1964 | Pitt et al. | 173/152 |
| 3,201,945 | A | * | 8/1965 | Sutton | 405/196 |
| 3,239,016 | A | * | 3/1966 | Alexander | 173/164 |
| 4,209,066 | A | * | 6/1980 | Watson | 166/377 |

* cited by examiner

*Primary Examiner* — Kenneth L Thompson
(74) *Attorney, Agent, or Firm* — Hedman & Costigan, P.C.; James V. Costigan

(57) ABSTRACT

A movable well drilling rig for drilling either on-shore or off-shore new in-line arranged oil, gas, mineral and water wells or for servicing in-line non-productive wells with well heads emerging from ground by at least three meters where the rig has a drilling mast supporting a vertically upward and downward movable drilling rotary head, where the drilling mast is operatively associated at least a pipe and drilling bit and stabilizer container, pipe and drilling bit and stabilizer element gripping and loader devices as well as driving motors, and a control operator, cab and auxiliary servicing devices, wherein all the above components are operatively supported either on a ground movable substructure or on a floating platform.

7 Claims, 5 Drawing Sheets

MOVABLE ROTARY WELL DRILLING RIG

BACKGROUND OF THE INVENTION

The present invention relates to a new type monolithic movable earth drilling rig and, more specifically, an automatic rotary rig for drilling, either on-shore or off-shore, new, oil, gas, mineral and water wells or for servicing unproductive existing wells to recover their production capability; said drilling rig including, as a main component thereof, a mast/derrick having a top head drive rotary head or Kelly swivel and rotary table and all other completion equipments, such as a rig control cabin, tubular or pipe element containers and loaders and lay up and down machine, and power supply necessary for the well drilling and production operations.

As is known, very important objectives to be met in a drilling rig are to provide said rig with great safety and production yield operation, a good level of automation during pipe handling and drilling, a very efficient and fast string pipe and casing pipe handling, a low power consumption and an easy maintenance capability.

While prior drilling systems have a rather satisfactory performance on the above standpoints, Applicant has found that they would be susceptible to further improvements.

SUMMARY OF THE INVENTION

Accordingly, the aim of the present invention is to improve the existing well rotary drilling and servicing rigs, by providing a new type of on-shore or off-shore well rotary drilling and servicing rig which allows to achieve in an optimum manner all the above mentioned objectives; it is a new type of rig which is very safe in operation, has a very high production yield, a good power optimization, very efficient, fast and automated drill pipes drill collars and casing tube handling, adapted to drill new wells or to service already existing wells to recover the production capabilities thereof, and which can be easily, quickly and simply serviced and efficiently operated and quickly moved from one location to another.

According to one aspect of the present invention, the above mentioned targets, as well as other targets, which will become more apparent hereinafter, are achieved by an on-shore or off-shore monolithic movable rig as herein disclosed and claimed.

BRIEF DESCRIPTION OF THE DRAWINGS

Further characteristics and advantages of the inventive rig will become more apparent hereinafter from the following detailed disclosure of a preferred, though not exclusive, embodiment thereof, which is illustrated, by way of an indicative, but not limitative example, in the accompanying drawings, where.

DESCRIPTION OF THE PREFERRED EMBODIMENTS

Figure 1:
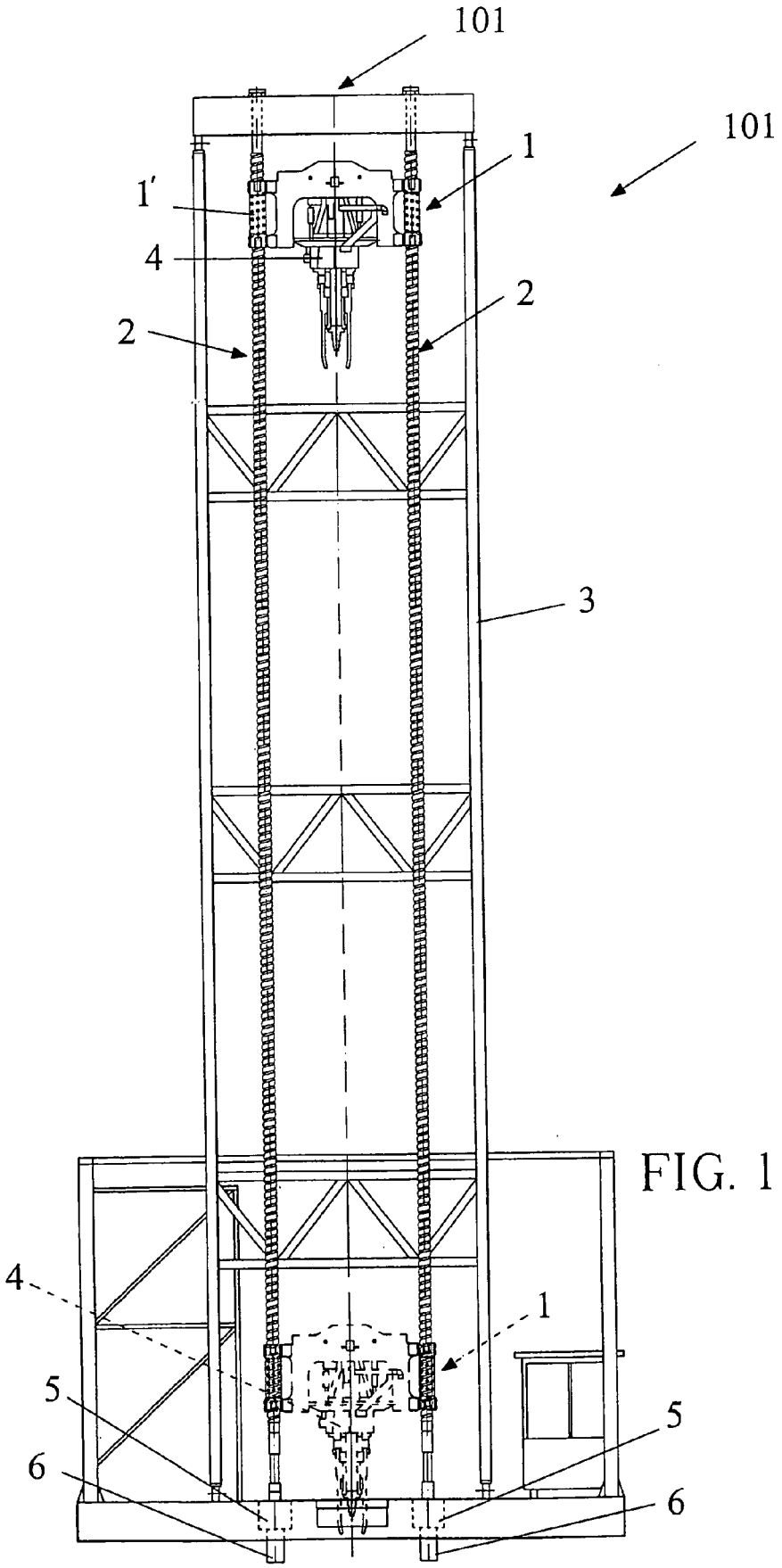
FIG. 1 schematically shows a drilling mast/derrick framework included in the drilling rig according to the present invention.

Before proceeding to a detailed description of the preferred embodiment of the invention, it should be pointed out that the inventive idea has been that of providing an on shore or off shore parallelogram type self erecting substructure on which are assembled and installed all the components of the inventive drilling rig, said platform supporting, more specifically, a drilling mast/derrick frame with inserted at least, but not limited to, one driving worm screw—nut screw assembly, moving up and down a top driving head or Kelly and swivel, sustained and driven by the worm screw and nut screw assembly, so as to perform a bidirectional vertical up and down movement, to add or extract from the well in particular screw-on and screw-off, range 2(9.0/9.5 mt long) tubular as drill pipes, drill collars, casing, in double or drilling bits and stabilizing elements, as well as all the other operating and motor driving equipments as necessary to drill new wells or service existing wells to recover their production yield.

According to the invention, the above mentioned operating systems or means, supported by said substructure or platform comprise pipe or tube loader means, including hydraulic clamp and gripping assemblies, supporting double or triple tubular elements taken from containers, which can be brought from horizontal to a vertical position, also supported by said substructure or platform, said loaders being designed to bring said tubular elements under and connect them to the driving head, on the well axis, said tubular elements being vertically stored and supported by an automated supporting frame (monkey board) also including a tubular clamping system, preferably of hydraulic type, for gripping the tubular elements, and bringing them from the center well and automatically to a tubular handling board assembly; said substructure or platform, with said loader means, tubular element containers and handling system supported thereby equipped with a skidding system adapted to move the assembled rig through comparatively small distances to drill cluster wells leaving a free space for well heads height of minimum three meters and more from the ground being drilled.

According to the invention, said substructure or platform further supports a movable operator cab, also mounted on a dedicated frame which, by a hydraulic cylinder and gear assembly, can be so driven as to bring a single operator to the center of the well.

Said mast/derrick and top drive are equipped with a braking system for braking the top drive head or Kelly in case the cables sustaining the load brake, by mean of braking bronze pad elements engaging on the sliding guides of the top drive or Kelly and swivel for braking the system as necessary.

The top drive or Kelly and swivel operating worm screw—nut screw assembly drives, as stated, said driving head with a bidirectional upward and downward vertical movement so that said driving head can screw on or off drill pies, or drill collars, having a length of about 9.2 meters (of a range 2 type), casing tubes of a length of about 13/14 meters with a single, double or triple arrangement and with useful stroke of 10, 20, 30 meters or more.

Figure 1A:
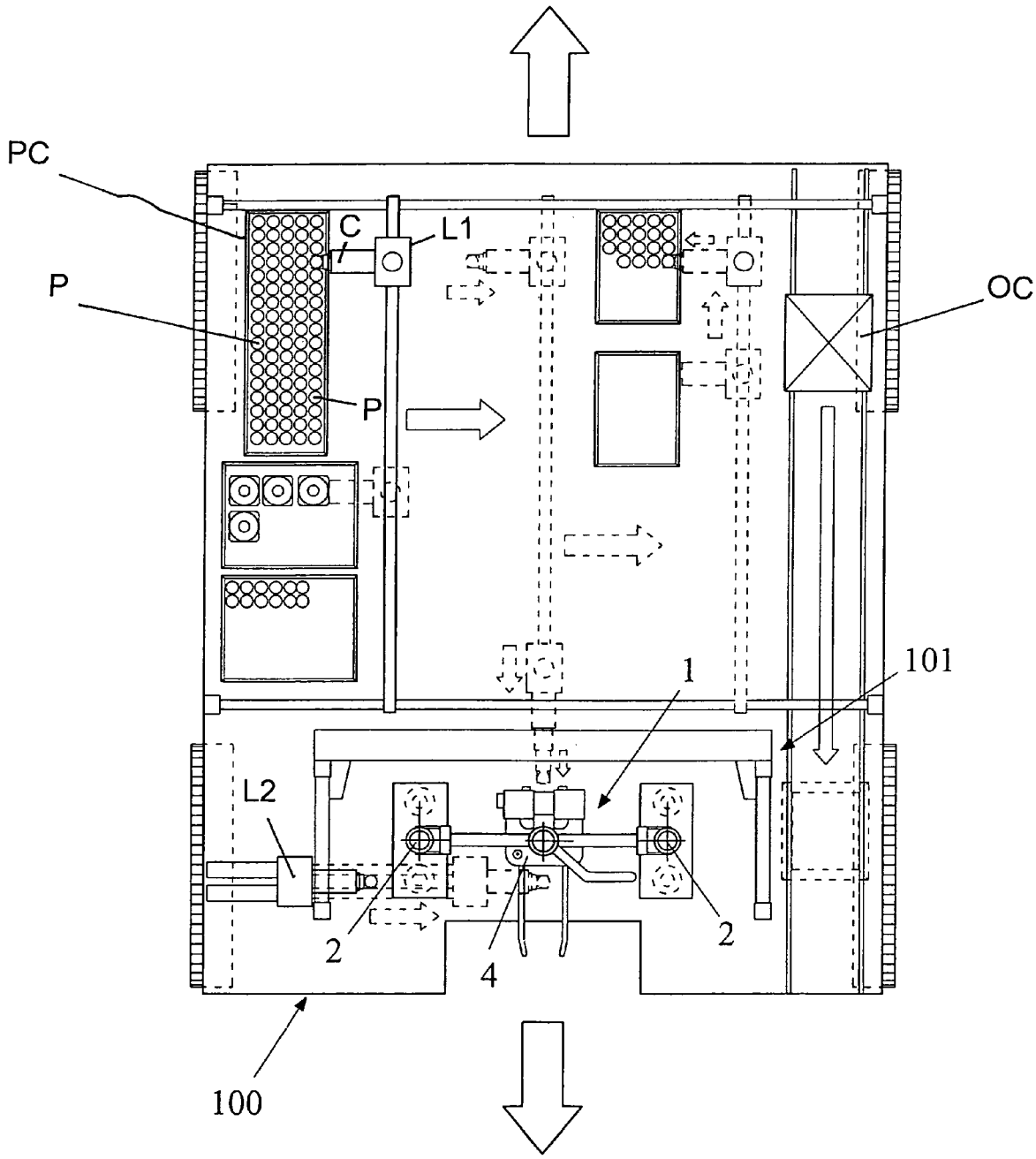
FIG. 1A is a schematic top plan view showing the mast/derrick supported on a parallelogram type self erecting substructure or off shore platform also supporting, according to the invention, all the operating systems of the inventive drilling rig, the solid line and dashed line arrows indicating movement directions of the operating systems and components of the inventive rig.

Turning now specifically to the above mentioned drawings, FIGS. 1 and 1A schematically shows a parallelogram type self erecting substructure for off shore and on shore rigs, skidded by means of counter frames and driving cylinders or driving motors not specifically shown, and supporting a rotary drilling mast/derrick frame or assembly 3, in turn supporting two or more left and right worm screws 2, each of which bidirectionally vertically rotatively drives a respective nut screw, generally indicated by the reference number 1, which in turn bidirectionally vertically upward and downward drives a rotary driving head (top drive) or Kelly and swivel (not shown) 4 which, for example in FIG. 1, is shown by a solid line in a top inactive position and, by a dashed line, in a bottom or active position, that is near a well to be drilled or a well head of an existing well to be serviced.

In this connection, it should be apparent that the number of worm screws 2 and respective nut screws 1 included in said derrick 3 can be any, according to requirements, for example a single worm screw—nut screw assembly, but preferably, as herein shown in the preferred embodiment, two left and right said assemblies as shown in FIG. 1 or more.

At the bottom of the Mast/derrick framework 3 are mounted the left and right worm screw bottom rotary driving systems 5, 6, each including a gear box 5 and respective one or more electrical motor assembly 6, only schematically shown.

Figure 2:
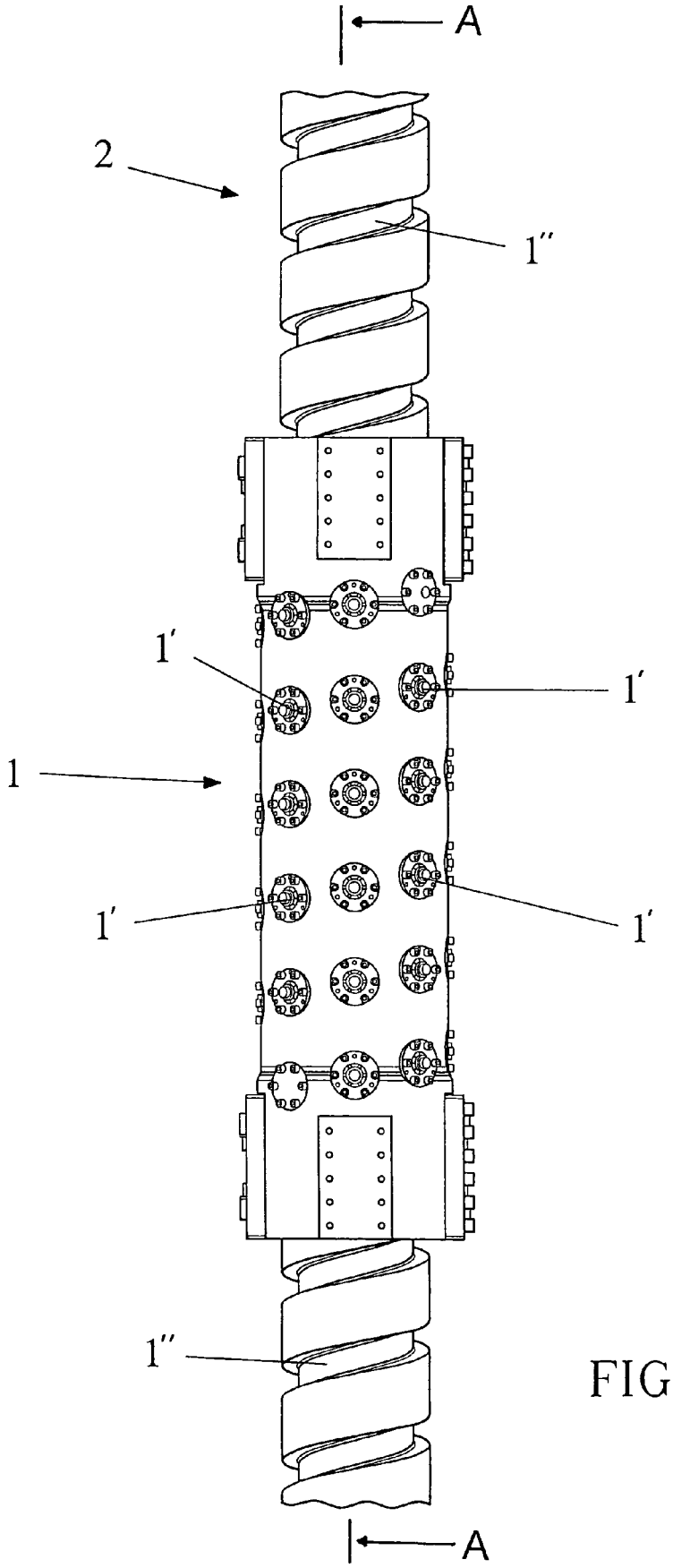
FIG. 2 is a partial broken-away schematic view showing a portion of a driving worm screw used to lift the drilling string in the drilling rig through a nut screw directly or by means of cables attached to the equalizer beam and to the top drive (or Kelly) mounted on and driven by the worm screw through a gear box and electrical motors.
Figure 2A:
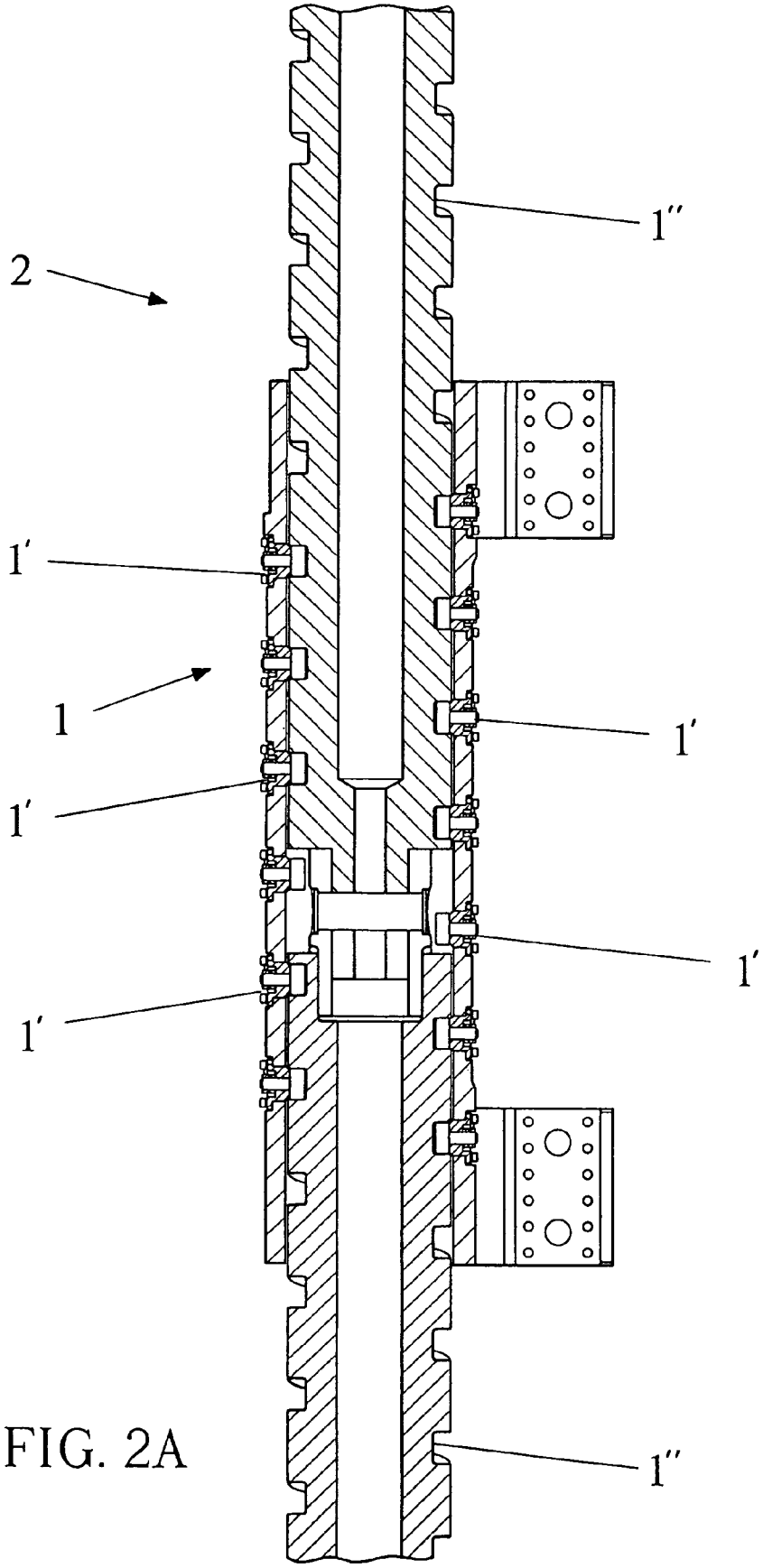
FIG. 2A is a partially broken-away longitudinal cross-section view of FIG. 2, substantially showing the section line A-A of FIG. 2.
Figure 3:
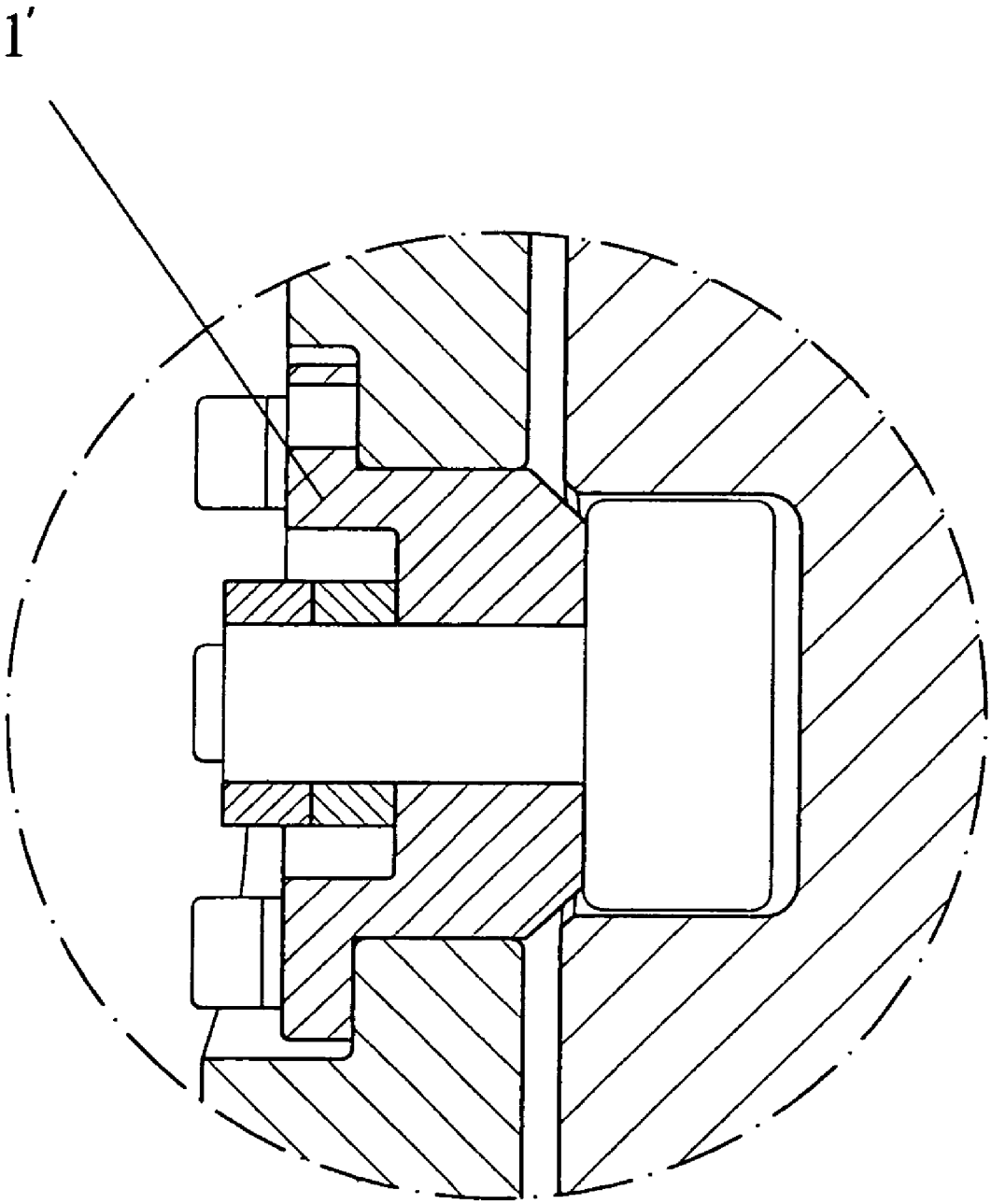
FIG. 3 is a detail view of a roller bearing assembly associated with/supported by said nut screw.

According to a further aspect of the invention, on the nut screws 1 are mounted a plurality of roller bearings 1' designed for evenly distributing the weight of the rotary driving head and drilling string or casing 4 on the groove 1" (FIG. 2) of the nut screw 1, said roller bearings 1' being advantageously of a low friction type.

Also according to a further aspect of the invention, each said worm screw 2 has a length corresponding either to the overall or to a half of the working stroke of the driving head 4, that is substantially to the overall height or a half of the height of the drilling mast/derrick 3, depending on the driving head mode of operation and connection, that is if said driving head 4 is directly driven by the driving worm screw—nut assembly 2, 1 through the overall useful working stroke of said driving head 4, or said driving head 4 is indirectly driven through a half of its working stroke by transmission ropes or cables, or a single transmission cable (both not shown) attached at one end thereof to said nut screw 1 and, at the other end thereof to the top portion 101 of the derrick framework 3.

From the above description it should be apparent that the inventive idea of providing a drilling rig including a drilling Mast/derrick 73F with all its components and auxiliary servicing equipments mounted on a single movable substructure or floating platform 100 for drilling a new well and/or recovering an existing well, with the existing well heads (not shown) elevating from the ground for three meters and more, provides a drilling rig having a very high operating system and production yield, a very low power consume, which rig can be easily controlled, automated and serviced, while allowing the individual tubular or pipe elements to be easily and quickly handled.

In this new type rig, the Mast/derrick defines a vertical shaft arrangement with a static hook load capability or pulling power up to 1000 tons and a useful vertical driving head stroke from the top to the bottom of 30 meters or more, and the Mast/derrick 3 can comprise either a telescopic or a fixed construction for vertically driving said head 4 by one, two or more worms screws which are rotatively driven by a pinion-gear wheel system controlled either by high power DC or AC electric motors or by hydraulic motors.

As stated, and with reference to FIG. 1A, the tubular element loader (lay up and down machine) L1 mounted in front of said substructure or platform include gripping arm clamps C for gripping the tubular elements or pipes P from a pipe container PC or oscillating pipe rack, said loader means L1, after having gripped each tubular element P, performing a 90° turning movement, advancing toward the center of the well whereas a telescopic hydraulic cylinder (not shown) raises the tubular elements P engaged therein, to bring said tubular elements on the axis of the top drive to screw on them and then, as required, to screw off them and bring them again to their containers PC which can be oscillated from a horizontal position to a vertical position to facilitate the loading therein of the tubular elements P.

A further advantage if the inventive rig is that it can be automatically controlled by a single operator, operating a PLC in turn controlled by said single operator by a control panel arranged on the operator movable control cab OC.

As stated, the inventive rig further comprises further bit loader and gripping means L2 for loading different diameter of drilling bits, connection subs and near hit and string stabilizers and reamers installed on a side of the mast framework 3, and being brought in to position driven by hydraulic cylinders (not shown in details).

The rig control house or "dog house" OC is advantageously mounted on a movable frame, also supported by said substructure or platform 100 and being also driven by hydraulic cylinders or/and gear motors to be positioned by the single operator either near or away from the operating situ, in particular to and away from the longitudinal axis of the well and/or the mast.

Advantageously, the inventive rig, as mentioned, further comprises a braking system (not shown in details) adapted to brake the driving head 4, said braking system including, for example, pad brakes providing a braking force on two side guides of said head 4.

From the above disclosure it should be apparent that the invention fully achieves the intended aim and objects.

While the invention has been disclosed with reference to a preferred embodiment thereof, it should be apparent that the disclosed embodiment is susceptible to several modifications and variations all coming within the scope of the invention which, it is stresses again, is that of supporting on a single movable substructure or floating platform both the drilling mast and all the components necessary for drilling new wells or recovering to production existing wells.

The invention claimed is:

1. A well drilling rig for drilling either on-shore or off-shore new in-line arranged oil, gas, mineral and water wells or for servicing in-line non productive wells with well heads emerging from the ground to a height of at least three meters, said drilling rig including a drilling mast supporting a vertically upward and downward movable drilling rotary head, said drilling mast being operatively associated with a plurality of operating means selected from the group comprising pipe and drilling bit and stabilizer container means, pipe gripping and loader means, drilling bit and stabilizer element gripping and loader means, motor driving means, and a control operator cab, characterized in that said drilling mast and all said plurality of operating means are operatively supported either on a ground movable substructure or on a water surface floating platform, and that said drilling mast comprises a fixed or telescopic mast construction having a static hook load capability up to 1000 metric tons with an up and down useful operating stroke of said rotary head of substantially minimum 30 meters, said rotary head being bidirectionally vertically supported by a number of vertical worm screw—nut screw assemblies extending through substantially an overall height of said drilling mast.

2. A well drilling rig according to claim 1, characterized in that said vertically worm screw—nut screw assemblies comprise two said worm screw—nut screw assemblies symmetrically arranged with respect to a vertical axis of said drilling mast and extending through substantially the overall height of said drilling mast, said two worm screw—nut screw assemblies slidably supporting said drilling head.

3. A well drilling rig according to claim 1, characterized in that said worm screw of said worm screw—nut screw assembly is operatively driven by a gear box and a motor driving means arranged at a bottom of said worm screw and including either DC or AC electric motors or hydraulic motors with respective gear reducing units.

4. A well drilling rig according to claim 1, characterized in that said pipe gripping loader means comprise a pipe gripping and loader means drive, preferably a hydraulic cylinder drive, for driving said pipe gripping and loader means, rotatively turning through substantially 90° said pipe gripping and loader means and further driving said pipe gripping and loader means toward and away from a substantially central portion of said well, for engaging and disengaging, by screwing on and off, said pipe elements to and from said driving head or sliding tubular from the ground to the working floor height at a disposal of links and elevator.

5. A well drilling rig according to claim 1, characterized in that said drilling rig comprises a plurality of pipe element storing containers each said pipe container being adapted to be oscillated from a horizontal position to a vertical position to facilitate the loading therein of said pipe elements.

6. A well drilling rig according to claim 1, characterized in that said nut screw of said worm screw—nut screw assembly supports a plurality of low friction roller bearings operating as a weight distributing means for evenly distributing the operating weight or load on a groove of said worm screw.

7. A well drilling rig according to claim 1, characterized in that said well drilling rig comprises an operator movable control cab also supported by said substructure or platform.

* * * * *